US007553599B2

(12) United States Patent
Ohtani

(10) Patent No.: US 7,553,599 B2
(45) Date of Patent: Jun. 30, 2009

(54) TONER, METHOD OF PREPARING THE TONER AND APPARATUS FOR PREPARING THE TONER

(75) Inventor: Shinji Ohtani, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 416 days.

(21) Appl. No.: 11/409,042

(22) Filed: Apr. 24, 2006

(65) Prior Publication Data

US 2006/0240354 A1 Oct. 26, 2006

(30) Foreign Application Priority Data

Apr. 22, 2005 (JP) ..... 2005-125277

(51) Int. Cl.
*G03G 9/08* (2006.01)

(52) U.S. Cl. ..... 430/137.1

(58) Field of Classification Search ..... 430/137.1
See application file for complete search history.

(56) References Cited

U.S. PATENT DOCUMENTS

| | | | | |
|---|---|---|---|---|
| 3,886,098 | A * | 5/1975 | DiSalvo et al. | 510/326 |
| 4,215,818 | A | 8/1980 | Hopkinson | |
| 5,716,751 | A | 2/1998 | Bertrand et al. | |
| 5,765,761 | A | 6/1998 | Law et al. | |
| 2002/0069971 | A1* | 6/2002 | Kaji et al. | 156/345.46 |
| 2003/0224271 | A1* | 12/2003 | Teshima | 430/105 |
| 2004/0048183 | A1* | 3/2004 | Teshima | 430/137.1 |
| 2005/0154088 | A1* | 7/2005 | Miura et al. | 523/223 |
| 2006/0227179 | A1* | 10/2006 | Temple et al. | 347/68 |
| 2006/0240354 | A1 | 10/2006 | Ohtani | |

FOREIGN PATENT DOCUMENTS

| | | | |
|---|---|---|---|
| EP | 1 372 042 | A2 | 12/2003 |
| EP | 1 703 332 | A2 | 9/2006 |
| JP | 06-308815 | | 11/1994 |
| JP | 07-152202 | | 6/1995 |
| KR | 10-0471750 | * | 3/2005 |
| WO | WO 2005/073815 | A2 | 8/2005 |

OTHER PUBLICATIONS

Abstract of CN 1341488. Mar. 27, 2002.*
Abstract of KR 471750. Mar. 16, 2005.*
U.S. Appl. No. 12/047,437, filed Mar. 13, 2008, Kuramoto, et al.
U.S. Appl. No. 11/376,286, filed Mar. 16, 2006, Ohtani.
U.S. Appl. No. 11/409,042, filed Apr. 24, 2006, Ohtani.
U.S. Appl. No. 11/851,475, filed Sep. 7, 2007, Watanabe, et al.

* cited by examiner

*Primary Examiner*—Hoa V Le
(74) *Attorney, Agent, or Firm*—Oblon, Spivak, McClelland, Maier & Neustadt, P.C.

(57) ABSTRACT

A toner, a method of and an apparatus for preparing a permanently-charged electret toner, including discharging a solution or dispersion including a resin and a colorant through a nozzle vibrating at a constant frequency to form a droplet; applying a direct potential to an electrode facing the nozzle to positively or negatively charge the droplet by an induction phenomenon to form a charged droplet; and drying and solidifying the charged droplet to be permanently charged.

12 Claims, 2 Drawing Sheets

TONER, METHOD OF PREPARING THE TONER AND APPARATUS FOR PREPARING THE TONER

BACKGROUND OF THE INVENTION

1. Field of the Invention

The present invention relates to a permanently-charged electret toner for use in developers for developing electrostatic latent images formed in electrophotography, electrostatic recording and electrostatic printing.

2. Discussion of the Background

Conventional developers for use in electrophotography, electrostatic recording and electrostatic printing, in their developing processes, are transferred to image bearers such as photoreceptors electrostatic latent images are formed on, transferred therefrom to a transfer medium such as a transfer paper, and fixed thereon.

As the developers for developing electrostatic latent images formed on image bearers, a two-component developer including a carrier and a toner, and a one-component developer without a carrier, such as a magnetic toner and a non-magnetic toner, are known.

As a dry toner for use in electrophotography, electrostatic recording and electrostatic printing, a pulverized toner is widely used, which is formed by kneading a toner binder such as styrene resins and polyester resins with a colorant, etc. upon application of heat, cooling the kneaded mixture to be solidified and pulverizing the solidified mixture.

Recently, polymerized toners prepared by suspension polymerization methods, emulsion polymerization condensation methods, etc. are being used.

In addition, Japanese Laid-Open Patent Publication No. 7-152202 discloses a polymer solution suspension method of using a volume contraction.

This method includes dispersing or dissolving toner constituents in a volatile solvent such as an organic solvent having a low boiling point to prepare a dispersion or a solution, emulsifying the dispersion or solution in an aqueous medium to form a droplet, and removing the volatile solvent.

The diversity of resins this method can use is wider than those of the suspension polymerization methods and emulsion polymerization condensation methods, and has an advantage of being capable of using a polyester resin effectively used for full-color images requiring transparency and smoothness.

However, conventional toners need a frictional charge with charging members such as a carrier, a developing sleeve and a developing doctor to be charged as desired.

As a charging method without a frictional charge, a method of injecting a charge to an electroconductive toner is disclosed, however, this cannot be applied to an insulating toner due to its poor charge injection efficiency.

In addition, the application of the electroconductive toner is limited in electrophotography because of its unstable chargeability and poor transferability.

Further, Japanese Laid-Open Patent Publication No. 6-308815 discloses a developing method without a frictional charge using an electret toner, however, the productivity thereof is low.

Because of these reasons, a need exists for a permanently-charged electret toner needing no complicated and costly toner charging mechanism or agitator, being uniformly charged without uneven charge quantity, having good storage stability and producing images faithful to latent images for long periods.

SUMMARY OF THE INVENTION

Accordingly, an object of the present invention is to provide a permanently-charged electret toner needing no complicated and costly toner charging mechanism or agitator, being uniformly charged without uneven charge quantity, having good storage stability and producing images faithful to latent images for long periods.

Another object of the present invention is to provide a method of preparing the toner.

A further object of the present invention is to provide an apparatus for preparing the toner.

These objects and other objects of the present invention, either individually or collectively, have been satisfied by the discovery of a method of preparing a permanently-charged electret toner, comprising discharging a solution or dispersion comprising a resin and a colorant through a nozzle vibrating at a constant frequency to form a droplet; applying a direct potential to an electrode facing the nozzle to positively or negatively charge the droplet by an induction phenomenon to form a charged droplet; and drying and solidifying the charged droplet to be eternally charged.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a permanently-charged electret toner needing no complicated and costly toner charging mechanism or agitator, being uniformly charged without uneven charge quantity, having good storage stability and producing images faithful to latent images for long periods.

The toner of the present invention is prepared by a method of preparing a permanently-charged electret toner, comprising discharging a solution or dispersion comprising a resin and a colorant through a nozzle vibrating at a constant frequency to form a droplet; and drying the droplet to be solidified, wherein the droplet is positively or negatively charged through an induction phenomenon by applying a direct potential to an electrode facing the nozzle. In addition, the droplet may be irradiated.

In the present invention, an electret toner having quite a good electret performance can be prepared by quite a simple method.

Apparatuses for preparing the toner of the present invention are not particularly limited, and any apparatus capable of preparing the toner by the above-mentioned method can be used. However, the apparatus at least has a droplet former discharging a solution or dispersion comprising a resin and a colorant through a nozzle vibrating at a constant frequency to form a droplet; and a dryer drying the droplet to be solidified, wherein the droplet is positively or negatively charged through an induction phenomenon by applying a direct potential to an electrode facing the nozzle.

Figure 1:
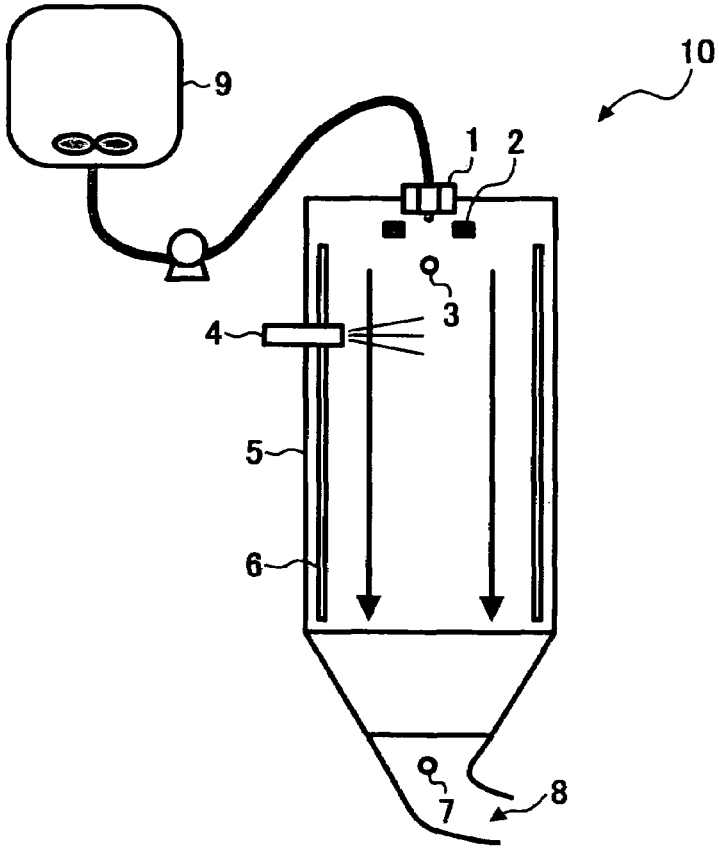
FIG. 1 is a schematic view illustrating an embodiment of an apparatus with a nozzle for use in preparation of the toner of the present invention.

FIG. 1 shows an apparatus for preparing a toner 10, having a nozzle 1 forming a droplet, a pair of electrodes 2, a photoionizer 4 irradiating soft X-ray and a toner collector 8 in a drying container 5.

In the apparatus for preparing a toner 10, a solution or a dispersion is discharged through the nozzle 1 as a droplet 3 from a dispersion/solution tank 9. The droplet is charged by the pair of electrodes 2, dried in a dry gaseous body, exposed to a predetermined radiation by the photoionizer 4, solidified while holding static electric charge and collected in the toner collector 8 to form a toner 7.

The nozzle 1 preferably vibrates at a constant frequency by expansion and contraction of a piezoelectric substance, and it is preferable that a discharge orifice thereof is formed of a metal plate having a thickness of from 5 to 50 μm and has a diameter of from 3 to 35 μm.

The constant frequency by expansion and contraction of a piezoelectric substance is preferably from 50 kHz to 50 MHz, and more preferably from 100 kHz to 10 MHz.

The number of discharge orifices used is preferably from 1 to about 300.

The pair of electrodes 2 performing an induction charge to the droplet 3 discharged from the nozzle 1 is preferably a pair of electrodes a DC voltage is applied to. The droplet is preferably induction-charged when passing between the pair of electrodes.

The solution or dispersion of toner constituents, prepared in the dispersion/solution tank 9 preferably has an electrolysis conductance not less than 1.0 H $10^{-5}$ S/m. Further, a solvent used in the solution or dispersion preferably has an electrolysis conductance not less than 1.0 H $10^{-5}$ S/m.

The droplet 3 is dried by a solvent remover. A dry gaseous body is flown in the same direction of the discharging direction of the droplet 3 to generate an air stream. The air stream transfers the droplet 3 in a solvent remover having a transfer route surrounded by an electrostatic curtain 6 charged to have the same polarity of the droplet 3 to remove a solvent therein.

The dry gaseous body is preferably an atmospheric air or a nitrogen gas, and a vortex flow thereof effectively dry the droplet.

After the droplet 3 is charged by the pair of electrodes 2, it is preferable that the droplet is temporarily neutralized by a discharger such as the photoionizer 4.

The photoionizer 4 neutralizes the droplet 3 with soft X-ray or a plasma irradiation.

The toner collector 8 collecting the toner 7 has a taper face wherein an orifice diameter gradually contracts. The exit is contacted more than the entrance, and the toner 7 is preferably transferred to a toner storage container (not shown) on the flow of the dry gaseous body from the exit.

The toner collector 8, a tube transferring the toner to the toner storage container and the toner storage container are preferably formed of an electroconductive material and earthed respectively.

In addition, the apparatus for preparing a toner 10 is preferably an explosion-proof apparatus.

The toner preferably has a ratio (weight-average particle diameter/number-average particle diameter) of weight-average particle diameter to a number-average particle diameter thereof from 1.00 to 1.05, and a weight-average particle diameter of from 1 to 20 μm.

The electret is typically permanently-polarized while a dipole thereof is oriented by melting an insulating material, particularly a polymer material, and freezing the material while applying a high voltage thereto.

Conventional electrets are industrially applied to film condensers and electret filters, however, a method of electretizing particulate resins such as a toner has not substantially been available because it is difficult to arrange the particulate resin at an electrode when applying a high voltage thereto and effectively apply a high voltage to an insulating powder having a surface area.

Corona charging methods, electron beam methods, soft X-ray irradiation methods are typically known to highly charge an insulating material.

However, each of these methods have a common problem of charging just a surface thereof because an electric field formed thereby prevents them from being charged when the surface thereof begins to accumulate the charge.

This is obvious particularly when particulate materials are charged, and even when a powder layer thereof is charged on a flat plate electrode, just a surface layer thereof is charged. This is because the surface area of the powder greatly increases.

As a method of effectively and uniformly charge a particulate material, a method of using an induction phenomenon to charge a droplet when discharged.

Specifically, in droplet generators such as a vibration orifice, a direct potential or a direct potential overlapped with an alternate potential reverse to a polarity of the droplet is applied to a facing electrode located facing to a nozzle of the orifice. When the nozzle plate is earthed, an induction phenomenon occurs to the droplet discharged from the nozzle. The droplet has a reverse polarity to that of the facing electrode and can impart electrostatic charge quantity according to a potential of the facing electrode.

This method well controls the charge quantity, can impart a constant electrostatic charge to the droplet, and therefore the droplet has a sharp charge quantity distribution.

As a method of corona charging floating solid particulate materials, methods of switching electric fields using a boxer charger are attempted as well. Actually comparing the charge quantity distribution by the boxer charger with that by the method of the present invention, the boxer charger has a very wide distribution having a range of 12±12 fC/particle and the method of the present invention has a very sharp distribution having a range of 101±2 fC/particle. A very high potential corona needs to be applied to a particulate material to be more charged and flammable particulate materials such as particulate resins are destroyed by fire quickly when applied with such a high potential corona.

In the present invention, a droplet can be charged until having a maximum charge in the atmosphere, i.e., until being Rayleigh-divided.

Further, the highly-charged droplet is dried and solidified to be a solid particulate material maintaining all the charge.

A droplet maximally charged is Rayleigh-divided and reduces its surface area when dried, however, the maximum charge in proportion to the surface area remains in the solid particulate material.

The droplet having a charge of 101±2 fC/particle has the same charge 101±2 fC/particle even when solidified.

The charge quantity of the droplet is controlled to have a maximum charge when becoming a solid particulate material.

Namely, as a method of preparing a highly-charged particulate material, the method of charging a droplet with an induction charge of the present invention is the best method in terms of controlling the charge quantity and highly charging.

Next, a method of electretizing a highly-charged particulate material is explained.

In the process of performing an induction charge to a droplet to be highly-charged, drying and solidifying the droplet, a charge (carrier) is partly separated from toner constituents dissolved or separated out in the droplet, such as a resin, a pigment and a wax when radiations such as soft X-ray is applied to the droplet drying.

A charge having a reverse polarity to a charge on the surface of the droplet is instantly attracted to the charge thereon to be neutral, and a charge having a same polarity is repulsed thereby and transferred toward the center of the droplet.

When the droplet is irradiated while drying, a charge having a same polarity as that of a charge applied to the droplet can be sealed therein when completely dried and solidified.

Therefore, the resultant particulate resin is very stably charged, i.e., the resin has a good electret performance.

This is because a charge is transferred to the center of the particulate resin.

A charge on the surface of the resin does not sufficiently draw electret performance, but a charge therein stabilizes the electret performance. Further, considering that a TSC peak temperature measured by a thermally-stimulated current measurement method is becoming higher, the charge trap energy is judged to be stabilized more deeply.

A conventional film-shaped electret stabilizes a charge by inducing a hetero charge on the backside thereof against a homo charge on the other side thereof, and is eternally polarized.

When a true charge is imparted to a particulate material, it cannot be expected that the charge is stabilized by the polarization. Therefore, it is considered that a complete electretization cannot be made except for sealing a charge in the particulate material.

From this point of view, the toner electretization of the present invention is considered to be only a good method of electretizing a powder.

In addition, even when the droplet is dried without being applied with a radiation such as an X-ray, the resultant particulate material is electretized although not so charged as when irradiated.

It is presumed that this is because the surface of the droplet is highly-charged, the surface area of the resultant particulate material decreases and the surface charge density quickly increases when dried and solidified, and the charge scatters therein due to electrostatic repulsion before the droplet is Rayleigh-divided.

The electretization in the process of preparing a solid particulate material from a droplet does not need melting upon application of heat as a solid particulate resin does.

A highly-electroconductive ion present in the droplet enables a charge to freely move around in a solution or a half solution, and the charge is blocked and frozen in a space when the droplet is completely dried to be a stable space charge.

The electretization is a highly-flexible method in terms of being performable at a room temperature and capable of using a solvent suitable to materials forming the particulate material.

Next, methods of preparing a microscopic droplet will be explained in detail.

Some methods are conventionally known such as a method typically called a vibration orifice method, of generating a microscopic droplet having a very uniform particle diameter by mechanically vibrating a nozzle when a solution is jet-sprayed therefrom to have shearing strength; various ink jet methods of applying a pressure pulse to a nozzle or applying a heat energy thereto to inflate air for jetting a microscopic droplet; and a mesh vibration method of discharging an atomized droplet, using a capillary effect of a liquid by ultrasonic-vibrating a plate having plural nozzles. Any of these methods can be used in the present invention for electretization.

Since particulate resins having electret performances, prepared by the above-mentioned methods, have electrostatic repulsions with respect to each other, they do not need an external additive such as a fluidity improver at all when used for preparing a toner.

Even when an external additive is added thereto for the purpose of reducing the adherence thereof, a quite small amount thereof sufficiently works when used together with the particulate resins having electret performances.

Since such external additives are preferably used as less as possible in terms of deterioration thereof due to stress and danger of ultrafine particulate materials to the human body, particulate resins having electret performances of the present invention is preferably used.

The electret toner of the present invention can easily be dispersed again on an air stream, i.e., floated.

The toner can easily be transferred to a developing area without transferers used in conventional electrophotographic methods.

Even a faint air stream such as an air stream made by an air pump can transfer the toner to a developing area to develop an electrostatic latent image.

In this case, the electrostatic latent image is developed by a powder cloud developing method, wherein a toner image is not disturbed by a magnetic brush an ideal cloud can be made without disturbance of an air stream, capable of developing the electrostatic latent image very well.

The toner of the present invention can be used in conventional developing methods, wherein a carrier and members such as a developing sleeve are used as toner transferers and friction chargers are not necessary at all. Since the selection of materials used in a coated layer on the surface of a carrier largely widens, the durability of a developer can be improved or less expensive materials can be used to reduce cost with materials which have not used.

Toner constituents for use in the present invention will now be explained in detail.

Any known resins can be used as binder resins of the toner.

Specific examples thereof include vinyl polymers including styrene monomers, acrylic monomers or methacrylic monomers, or copolymers including two or more of the monomers; polyester polymers; polyol resins; phenol resins; silicone resins; polyurethane resins; polyamide resins; furan resins; epoxy resins; xylene resins; terpene resins; coumarone-indene resins; polycarbonate resins; petroleum resins; etc.

Specific examples of the styrene monomers include styrenes or their derivatives such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dochlorostyme, m-nitrostyrene, o-nitrostyrene and p-nitrostyrene.

Specific examples of the acrylic monomers include an acrylic acid or their esters such as methylacrylate, ethylacrylate, n-butylacrylate, isobutylacrylate, n-octylacrylate, n-dodecylacrylate, 2-ethylhexylacrylate, stearylacrylate, 2-chloroethylacrylate and phenylacrylate.

Specific examples of the methacrylic monomers include a methacrylic acid or their esters such as a methacrylic acid, methylmethacrylate, ethylmethacrylate, propylmethacrylate, n-butylmethacrylate, isobutylmethacrylate, n-octylmethacrylate, n-dodecylmethacrylate, 2-ethylhexylmethacrylate, stearylmethacrylate, phenylmethacrylate, dimethylaminoethylmethacrylate and diethylaminoethylmethacrylate.

Specific examples of other monomers forming the vinyl polymers or copolymers include the following materials (1) to (18):

(1) monoolefins such as ethylene, propylene, butylene and isobutylene; (2) polyenes such as butadiene and isoprene; (3) halogenated vinyls such as vinylchloride, vinylidenechloride, vinylbromide and vinylfluoride; (4) vinyl esters such as vinylacetate, vinylpropionate and vinylbenzoate; (5) vinylethers such as vinylmethylether, vinylethylether and vinylisobutylether; (6) vinylketones such as vinylmethylketone, vinylhexylketone and methyl isopropenylketone; (7) N-vinyl compounds such as N-vinylpyrrole, N-vinylcarbazole, N-vinylindole and N-vinylpyrrolidone; (8) vinylnaphthalenes; (9) acrylic acid or methacrylic acid derivatives such as acrylonitrile, methacrylonitrile and acrylamide; (10) unsaturated diacids such as a maleic acid, a citraconic acid, an itaconic acid, an alkenylsuccinic acid, a fumaric acid and a mesaconic acid; (11) unsaturated diacid anhydrides such as a maleic acid anhydride, a citraconic acid anhydride, an itaconic acid anhydride and an alkenylsuccinic acid anhydride; (12) monoesters of unsaturated diacids such as monomethylester maleate, monoethylester maleate, monobutylester maleate, monomethylester citraconate, monoethylester citraconate, monobutylester citraconate, monomethylester itaconate, monomethylester alkenylsuccinate, monomethylester fumarate and monomethylester mesaconate; (13) esters of unsaturated diacids such as a dimethyl maleic acid and a dimethyl fumaric acid; (14) α,β-unsaturated acids such as a crotonic acid and a cinnamic acid; (15) α,β-unsaturated acid anhydrides such as crotonic acid anhydride and a cinnamic acid anhydride; (16) monomers having a carboxyl group, such as anhydrides of the α,β-unsaturated acids and lower fatty acids, an alkenylmalonic acid, alkenylglutaric acid alkenyladipic acid, their anhydrides and monoesters; (17) hydroxyalkylester acrylates or methacrylates such as 2-hydroxyethylacrylate, 2-hydroxyethylmethacrylate and 2-hydroxypropylmethacrylate; and (18) monomers having a hydroxy group such as 4-(1-hydroxy-1-methylbutyl)styrene and 4-(1-hydroxy-1-methylhexyl)styrene.

The vinyl polymer or copolymer of the binder resin may have a crosslinked structure formed by a crosslinker having 2 or more vinyl groups. Specific examples of the crosslinker include aromatic divinyl compounds such as divinylbenzene and divinylnaphthalene; diacrylate compounds bonded with an alkyl chain, such as ethyleneglycoldiacrylate, 1,3-butyleneglycoldiacrylate, 1,4-butanedioldiacrylate, 1,5-pentanedioldiacrylate, 1,6-hexanedildiacrylate, neopentylglycoldiacrylate or their dimethacrylates; and diacrylate compounds bonded with an alkyl chain including an ester bond, such as diethyleneglycoldiacrylate, triethyleneglycoldiacrylate, tetraethyleneglycoldiacrylate, polyethyleneglycoldiacrylate#400, polyethyleneglycoldiacrylate#600, dipropyleneglycoldiacrylate or their dimethacrylates.

Diacrylate or dimethacrylate compounds bonded with a chain including an aromatic group and an ether bond can also be used.

Polyester diacrylates include a product named MANDA from NIPPON KAYAKU CO., LTD.

Specific examples of a multifunctional crosslinker include pentaerythritoltriacrylate, trimethylolethanetriacrylate, trimethylolpropanetriacrylate, tetramethylolmethanetetraacrylate, oligoesteracrylate and their methacrylates, triallylcyanurate and triallyltrimellitate.

The toner preferably includes the crosslinker in an amount of 0.001 to 10 parts by weight, more preferably from 0.03 to 5 parts by weight based on total weight of the monomer.

Among these crosslinking monomers, the aromatic divinyl compounds, particularly the divinylbenzene and the diacrylate compounds bonded with a bonding chain including an aromatic group and an ether bond are preferably used in terms of the fixability and offset resistance of the resultant toner. Further, styrene copolymers and styrene-acrylic copolymers are more preferably used.

Specific examples of a polymerization initiator used for preparing the vinyl polymer or copolymer include azo polymerization initiators such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(cyclohexanecarbonitrile), 2-(carbamoylazo)-isobutyronitrile, 2,2'-azobis(2,4,4-trimethylpentane), 2-phenylazo-2',4'-fimethyl-4'-methoxyvaleronitrile and 2,2'-azobis(2-methylpropane); ketone peroxides such as methyl ethyl ketone peroxide, acetylacetone peroxide and cyclohexanone peroxide; 2,2-bis(tert-butylperoxy)butane; tert-butylhydroperoxide; cumenehydroperoxide; 1,1,3,3-tetramethylbutylhydroperoxide; di-tert-butylperoxide; tert-butylcumylperoxide; di-cumylperoxide; α-(tert-butylperoxy)isopropylbenzene; isobutylperoxide; octanoylperoxide; decanoylperoxide; lauroylperoxide; 3,5,5-trimethylhexanoylperoxide; benzoylperoxide; m-tolylperoxide; di-isopropylperoxydicarbonate; di-2-ethylhexylperoxydicarbonate; di-n-propylperoxydicarbonate; di-2-ethoxyethylperoxycarbonate; di-ethoxyisopropylperoxydicarbonate; di(3-methl-3-methoxybutyl)peroxycarbonate; acetylcyclohexylsulfonylperoxide; tert-butylperoxyacetate; tert-butylperoxyisobutylate; tert-butylperoxy-2-ethylhexalate; tert-butylperoxylaurate; tert-butyloxybenzoate; tert-butylperoxyisopropylcarbonate; di-tert-butylperoxyisophthalate; tert-butylperoxyallylcarbonate; isoamylperoxy-2-ethylhexanoate; di-tert-butylperoxyhexahydroterephthalate; tert-butylperoxyazelate; etc.

When the binder resin is selected from styrene-acrylic resins, the binder resin preferably includes elements soluble with tetrahydrofuran (THF), having at least one peak in a range of 3,000 to 50,000 (number-average molecular weight) and at one peak in a range not less than 100,000 in a molecular weight distribution by GPC thereof in terms of the fixability, offset resistance and storage stability of the resultant toner.

In addition, the THF-soluble elements having a molecular weight not greater than 100,000 is preferably from 50 to 90% by weight based on total weight of the THF-soluble elements. Further, the THF-soluble elements preferably have a main peak in a molecular weight range of from 5,000 to 30,000, and more preferably from 5,000 to 20,000.

When the binder resin is selected from vinyl polymers such as styrene-acrylic resins, the binder resin preferably has an acid value of from 0.1 to 100 mgKOH/g, more preferably from 0.1 to 70 mgKOH/g, and much more preferably from 0.1 to 50 mgKOH/g.

Specific examples of monomers forming polyester polymers include the following materials.

Specific examples of bivalent alcohol include diols such as ethyleneglycol, propyleneglycol, 1,3-butanediol, 1,4-butanediol, 2,3-butanediol, 1,4-butenediol, diethyleneglycol, triethyleneglycol, 1,5-pentanediol, 1,6-hexanediol, neopentylglycol, 2-ethyl-1,3-hexanediol, and diols formed by polymerizing hydrogenated bisphenol A or bisphenol A with cyclic ethers such as an ethylene oxide and a propylene oxide.

In order to crosslink polyester resins, alcohol having 3 valences or more is preferably used together.

Specific examples of polyalcohol having 3 or more valences include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxybenzene, etc.

Specific examples of acids forming the polyester polymers include benzene dicarboxylic acids or their anhydrides such as a phthalic acid, an isophthalic acid and a terephthalic acid; alkyl dicarboxylic acids or their anhydrides such as a succinic acid, an adipic acid, a sebacic acid and an azelaic acid; unsaturated diacids such as a maleic acid, a citraconic acid, an itaconic acid, an alkenylsuccinic acid, a fumaric acid and a mesaconic acid; and unsaturated diacid anhydrides such as a maleic acid anhydride, a citraconic acid anhydride, an itaconic acid anhydride and an alkenylsuccinic acid anhydride; etc.

Specific examples of polycarboxylic acids having 3 or more valences include a trimellitic acid, a pyromellitic acid, a 1,2,4-benzenetricarboxylic acid, a 1,2,5-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, a 1,3-dicarboxyl-2-methylmethylenecarboxypropane, tetra(methylenecarboxyl)methane, 1,2,7,8-octantetracarboxylic acids, empol trimer or their anhydrides, or those partially replaced with lower alkyl esters, etc.

When the binder resin is a polyester resin, the binder resin preferably includes elements soluble with tetrahydrofuran (THF), having at least one peak in a range of 3,000 to 50,000 (number-average molecular weight) in a molecular weight distribution by GPC thereof in terms of the fixability and offset resistance of the resultant toner.

In addition, the THF-soluble elements having a molecular weight not greater than 100,000 is preferably from 60 to 100% by weight based on total weight of the THF-soluble elements. Further, the THF-soluble elements preferably have a main peak in a molecular weight range of from 5,000 to 20,000.

When the binder resin is a polyester resin, the binder resin preferably has an acid value of from 0.1 to 100 mgKOH/g, more preferably from 0.1 to 70 mgKOH/g, and much more preferably from 0.1 to 50 mgKOH/g.

In the present invention, the molecular weight distribution of the binder resin is measured by gel permeation chromatography (GPC) using THF as a solvent.

In the vinyl polymers and/or polyester resins, resins including monomers reactable therewith can be used.

Specific examples of the monomers forming the polyester resin, reactable with the vinyl polymer include unsaturated dicarboxylic acids or their anhydrides such as a phthalic acid, a maleic acid, a citraconic acid and an itaconic acid. Specific examples of the monomers forming the vinyl polymer include monomers having a carboxyl group or a hydroxy group, and an acrylic acid or ester methacrylates.

When the polyester polymer, vinyl polymer and other binder resins are used together, the united resins preferably includes resins having an acid value of from 0.1 to 50 mgKOH/g in an amount of 60% by weight.

In the present invention, the acid value of the binder resin can be measured according to JIS K-0070 as follows.

(1) Additives besides the binder resin (polymer) are removed from a sample or an acid value and a content of the additives besides the binder resin are measured before measured. 0.5 to 2.0 g of the sample is precisely weighed and the weight of the polymer is W g. For example, when the acid value of a binder resin in a toner is measured, the acid value and content of a colorant or a magnetic material are measured beforehand, and the acid value of the binder resin is calculated.

(2) The samples is dissolved with 150 ml of a mixture of toluene/ethanol (volume ratio 4/1) to prepare a solution in a beaker having a capacity of 300 ml.

(3) The solution is titrated with a potentiometric titrator using an ethanol solution 0.1 mol/l KOH.

(4) The usage of the ethanol solution is S (ml), and at the same time, the usage thereof without the sample is B (ml) and the acid value is determined by the following formula:

$$\text{acid value (mg KOH/g)}=[(S-B)\times f\times 5.61]/W$$

wherein f is a factor of KOH.

The binder resin and constituents including the binder resin of the toner preferably has a glass transition temperature of from 35 to 80° C., and more preferably from 40 to 75° C. in terms of the storage stability of the resultant toner.

When lower than 35° C., the resultant toner tends to deteriorate in an environment of high temperature, and have offset problems when fixed.

When higher than 80° C., the fixability thereof tends to deteriorate.

Specific examples of magnetic materials for use in the present invention include (1) magnetic iron oxides such as magnetite, maghematite and ferrite and iron oxides including other metal oxides; (2) metals such as iron, cobalt and nickel or their metal alloys with metals such as aluminum, cobalt, copper, lead, magnesium, tin, zinc, antimony, beryllium, bismuth, cadmium, calcium, manganese, selenium, titanium, tungsten and vanadium; and (3) their mixtures.

Specific examples thereof include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, an iron powder, a cobalt powder, a nickel powder, etc. These can be used alone or in combination. Particularly, fine powders of $Fe_3O_4$ and $\gamma$-$Fe_2O_3$ are preferably used.

In addition, magnetic iron oxides such as magnetite, maghematite and ferrite including a heterogeneous element or their mixtures can also be used.

Specific examples of the heterogeneous element include lithium, beryllium, boron, magnesium, aluminum, silicon, phosphorus, germanium, zirconium, tin, sulfur, calcium, scandium, titanium vanadium, chrome, manganese, cobalt, nickel, copper, zinc, gallium, etc. Particularly, magnesium, aluminum, silicon, phosphorus or zirconium is preferably used.

The heterogeneous element may be taken in a crystal lattice of the iron oxide or therein as an oxide. Alternatively, the heterogeneous element may be present on the surface thereof as an oxide or a hydroxide. The heterogeneous element is preferably included therein as an oxide.

The heterogeneous element can be taken in a magnetic material by mixing a salt thereof when preparing the magnetic material and performing a pH control.

In addition, the heterogeneous element can be separated out on the surface of a magnetic material by performing the pH control or adding the salt thereof and performing the pH control after preparing the magnetic material.

The toner preferably includes the magnetic material in an amount of from 10 to 200 parts by weight, and more preferably from 20 to 150 parts by weight per 100 parts by weight of the binder resin.

The magnetic material preferably has a number-average particle diameter of from 0.1 to 2 μm, and more preferably from 0.1 to 0.5 μm. The number-average particle diameter can be determined by measuring a photograph thereof, zoomed by a transmission electron microscope, with a digitizer, etc.

The magnetic material preferably has a coercivity of from 2 to 150 Oe, a saturated magnetization of from 50 to 200 emu/g and a residual magnetization of from 2 to 20 emu/g when applied with 10 k Oe.

The magnetic material can be used as a colorant. Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and their mixtures.

The toner preferably includes the colorant in an amount of from 1 to 15% by weight, and more preferably from 3 to 10% by weight.

The colorant for use in the present invention can be used as a masterbatch when combined with a resin.

Specific examples of the resin used in the masterbatch or used with the masterbatch include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The masterbatch can be prepared by mixing and kneading a resin and a colorant upon application of high shearing stress thereto.

In this case, an organic solvent is preferably used to increase interactions between the colorant and the resin.

In addition, flushing methods, wherein an aqueous paste including a colorant is mixed with a resin solution of an organic solvent to transfer the colorant to the resin solution and then the aqueous liquid and organic solvent are separated and removed, is preferably used because the resultant wet cake of the colorant can be used as it is.

A three roll mill is preferably used for kneading the mixture upon application of high shearing stress.

The toner preferably includes the colorant in an amount of from 0.1 to parts by weight per 100 parts by weight of the binder resin.

The toner of the present invention may be mixed with a carrier and used as a two-component developer.

Conventional carriers such as ferrite and magnetite, and resin-coated carriers can be used.

The resin-coated carrier is formed of a carrier core material and a coating material, i.e., a resin coating the surface of the carrier core material. Specific examples of the resin include styrene-acrylic resins such as a styrene-esteracrylate copolymer and a styrene-estermethacrylate copolymer; acrylic resins such as an esteracrylate copolymer and an estermethacrylate copolymer; fluorine-containing resins such as polytetrafluoroethylene, monochlorotrifluoroethylene polymer and polyvinylidene-fluoride; a silicone resin; a polyester resin; a polyamide resin; polyvinylbutyral; and an aminoacrylate resin. Besides, any resins such as an ionomer resin and a polyphenylenesulfide resin usable as a coating material for a carrier can be used. These can be used alone or in combination.

In addition, a binder carrier core, wherein a magnetic powder is dispersed in a resin, can also be used.

Methods of coating a resin coating material on the surface of the carrier core include dissolving or suspending a resin in a solvent to prepare a coating solution and coating the coating solution thereon; and simply mixing a resin and the carrier core in the state of powders.

The resin-coated carrier preferably includes a resin coating material in an amount of from 0.01 to 5% by weight, and more preferably from 0.1 to 1% by weight.

Specific examples of use, wherein a magnetic material is coated with a coating mixture including two or more materials, include carriers formed of (1) 12 parts of a mixture of dimethylchlorosilane and dimethylsilicone oil (5/1) and 100 parts of a fine powder of titanium oxide; and (2) 20 parts of a mixture of dimethylchlorosilane and dimethylsilicone oil (5/1) and 100 parts of a fine powder of silica.

As the resin coating material, a styrene-methylmethacrylate copolymer, mixtures of fluorine-containing resins and styrene copolymers or a silicone resin is preferably used. Particularly, the silicone resin is more preferably used.

Specific examples of the mixtures of fluorine-containing resins and styrene copolymers include a mixture of polyvinylidene fluoride and a styrene-methylmethacrylate copolymer; and a mixture of a polytetrafluoroethylene and a styrene-methylmethacrylate copolymer; a mixture of vinylidene fluoride-tetrafluoroethylene copolymer (10/90 to 90/10), a styrene-acrylate2-ethylhexyl copolymer (10/90 to 90/10) and a styrene-acrylate2-ethylhexyl-methylmethacrylate copolymer (20 to 60/5 to 30/10/50).

Specific examples of the silicone resin include a nitrogen-containing silicone resin and a modified silicone resin formed from a reaction between a nitrogen-containing silane coupling agent and a silicone resin.

Magnetic materials for the carrier core include iron oxides such as ferrite, iron-excess ferrite, magnetite and γ-iron oxide; an metals such as iron, cobalt, nickel and their metal alloys.

Specific examples of elements included therein include iron, cobalt, nickel, aluminum, copper, lead, magnesium, tin, zinc, antimony, beryllium, bismuth, calcium, manganese, selenium, titanium, tungsten, vanadium, etc.

Copper-zinc-iron ferrite mainly including copper, zinc and iron; and manganese-magnesium-iron ferrite mainly including manganese, magnesium and iron are preferably used.

The carrier preferably has a resistivity of from $10^6$ to $10^{10}$ Ω·cm by controlling the concavities and convexities on the surface thereof an amount of a resin coated thereon.

The carrier preferably has a particle diameter of from 4 to 200 μm, more preferably from 10 to 150 μm, and much more preferably from 20 to 100 μm.

Particularly, the resin-coated carrier preferably has a 50% particle diameter of from 20 to 70 μm.

The two-component developer preferably includes the toner of the present invention in an amount of from 1 to 200 parts by weight, and more preferably from 2 to 50 parts by weight per 100 parts by weight of the carrier.

The toner of the present invention may include a wax besides a binder resin and a colorant.

Any known waxes can be used, and specific examples thereof include aliphatic hydrocarbon waxes such as low-molecular-weight polyethylene, low-molecular-weight polypropylene, a polyolefin wax, a microcrystalline wax, a paraffin wax and a sasol wax; aliphatic hydrocarbon wax oxides such as polyethylene oxide wax or their block copolymers; plant waxes such as a candelilla wax, a carnauba wax, a Japan wax, and a jojoba wax; animal waxes such as a bees wax, a lanolin and a whale wax; mineral waxes such as an ozokerite, a ceresin and a petrolatum; waxes mainly including fatty ester such as a montanic acid ester wax and a mosquito star wax; and waxes having partially or wholly deacidified fatty ester.

Specific examples of the wax further include saturated straight-chain fatty acids such as a palmitic acid, a stearic acid, a montanic acid and a straight-chain alkyl carboxylic acid having a straight-chain alkyl group; unsaturated fatty acids such as an eleostearic acid; saturated alcohols such as stearyl alcohol, behenyl alcohol, ceryl alcohol, mesilyl alcohol and long-chain alkyl alcohol; polyalcohols such as sorbitol; fatty acid amides such as amide linoleate, amide olefinate and amide laurate; saturated fatty acid bismaides such as methylenebisamide caprate, ethylenebisamide laurate and hexamethylenebisamide stearate; unsaturated fatty acid amides such as ethylenebisamide oleate, hexamethylenebisamide oleate, N,N'-dioleylamide adipate and N,N'-dioleylamide sebaciate; aromatic bismaides such as m-xylenebisamide stearate and N,N-distearylamide isophthalate; fatty acid metal salts such as calcium stearate, calcium laurate, zinc stearate and magnesium stearate; an aliphatic hydrocarbon wax grafted with a vinyl monomer such as styrene and an acrylic acid; a partially esterified compound of fatty acids such as monoglyceride behenate and polyalcohol; and a methyl ester compound having a hydroxyl group, formed by adding a hydrogen atom to a vegetable oil.

Preferred waxes include polyolefin formed by radically polymerizing olefin under high pressure; polyolefin formed by refining a low-molecular-weight byproduct when polymerizing high-molecular-weight polyolefin; polyolefin formed by polymerizing olefin with a catalyst such as a Ziegler catalyst and a metallocene catalyst under low pressure; polyolefin formed by polymerizing olefin using a radiation, an electromagnetic ray or light; low-molecular-weight polyolefin formed by pyrolyzing high-molecular-weight polyolefin; a paraffin wax; a microcrystalline wax; a Fischer-Tropsh wax; synthetic hydrocarbon waxes synthesized by a synthol method, a hydronalium call method, etc.; synthetic waxes having a monomer having a carbon atom; hydrocarbon waxes having a functional group such as a hydroxyl group or a carboxyl group; mixtures of hydrocarbon waxes and hydrocarbon waxes having a functional group; and waxes graft-modified with a vinyl monomer such as styrene, ester maleate, acrylate, methacrylate and maleic acid anhydride.

In addition, these waxes having sharper molecular weight distributions after being subjected to a press sweating process, a solvent process, a recrystallization process, a vacuum distillation process, a supercritical gas extraction process or a solution crystallization process are preferably used. Further, waxes, wherein low-molecular-weight fatty acids, low-molecular-weight solid alcohols, low-molecular-weight solid compounds and other impurities are removed from these waxes, are preferably used as well.

The wax preferably has a melting point of from 70 to 140° C., and more preferably from 70 to 120° C. to balance the fixability and offset resistance of the resultant toner.

When lower than 70° C., blocking resistance thereof tends to deteriorate. When higher than 140° C., the offset resistance thereof is difficult to develop.

In addition, the combination of two or more waxes can develop plasticizability and releasability of a wax at the same time.

A wax having plasticizability has a low melting point, or a branched-chain or a polar group on its molecular structure. A wax having releasability has a low melting point, or a straight-chain or nonpolar group without a functional group on its molecular structure.

Specific examples of the combinations include a combination of two ore more waxes having differences of melting point of from 10 to 100° C.; and a combination of polyolefin and graft-modified polyolefin.

When two waxes having similar structures are used, combinations of a low-melting-point wax relatively having plasticizability and a high-melting-point wax relatively having releasability are preferably used. The melting points preferably have a difference from 10 to 100° C. to effectively develop their separate functions. At least one of the waxes preferably has a melting point of from 70 to 120° C., and more preferably from 70 to 100° C. to exert the functional separation effect.

Waxes having branched-chain structures, polar groups such as functional groups, or waxes modified with components different from their main components relatively exert their plasticizabilities. On the other hand, waxes having straight-chain structure, nonpolar groups without functional groups, or unmodified waxes relatively exert their releasabilities.

Preferred combinations of the waxes include a combination of a polyethylene homopolymer or copolymer primarily consisting of ethylene and a polyolefin homopolymer or copolymer primarily consisting of olefin besides ethylene; a combination of polyolefin and graft-modified polyolefin; a combination of an alcohol wax, a fatty acid wax or an ester wax and a hydrocarbon wax; a combination of a Fischer-Tropsh wax or a polyolefin wax and a paraffin wax or a microcrystalline wax; a combination of a Fischer-Tropsh wax and a polyolefin wax; a combination of a paraffin wax and a microcrystalline wax; a carnauba wax, a candelilla wax, a rice wax or a montan wax and a hydrocarbon wax.

The wax preferably has an endothermic peak in a range of from 70 to 110° C., and further a maximum peak therein when measured by a DSC method to balance the storage stability and fixability of the resultant toner.

The toner of the present invention preferably includes waxes in an amount of from 0.2 to 20 parts by weight, and more preferably from 0.5 to 10 parts by weight per 100 parts by weight of a binder resin.

The melting point of the wax is the maximum endothermic peak when measured by a DSC method.

The endothermic peak of the wax or toner is preferably measure by a high-precision inner-heat input-compensation differential scanning calorimeter.

The measurement method is based on ASTM D3418-82.

A DSC curve measured when the temperature is increased at 10° C./min after increasing and decreasing the temperature is used.

The toner of the present invention may include a fluidity improver.

The fluidity improver is added to the surface thereof to improve the fluidity thereof.

Specific examples thereof include fluorine-containing resin powders such as carbon black, a vinylidene fluoride fine powder and a polytetrafluoroethylene fine powder; a silica fine powder such as a wet method silica and a dry method silica; a titanium oxide fine powder; an alumina fine powder; and a surface-treated silica, a surface-treated titanium oxide and a surface-treated alumina with a silane coupling agent, a titanium coupling agent or a silicone oil.

Particularly, the silica fine powder, titanium oxide fine powder and alumina fine powder are preferably used. The surface-treated silica with a silane coupling agent or a silicone oil is more preferably used.

The fluidity improver preferably has an average primary particle diameter of from 0.001 to 2 μm, and more preferably from 0.002 to 0.2 μm.

Preferred silica fine powders include a fine powder prepared by vapor-phase oxidizing a silicon halogen compound, i.e. a dry method silica or a fumed silica.

Specific examples of the marketed silica fine powders include AEROSIL-130, -300, -380, -TT600, -MOX170, -MOX80 and -COK84 from NIPPON AEROSIL CO., LTD.; Ca—O—SiL-M-5, -MS-7, -MS-75, -HS-5 and -EH-5 from Cabot Corp.; Wacker HDK-N20, -V15, -N20E, -T30 and -T40 from WACKER-CHEMIEGMBH; D-CFineSilica from Dow Corning Corp.; and Fansol from Fransil.

The silica fine powder prepared by vapor-phase oxidizing a silicon halogen compound is preferably hydrophobized.

The hydrophobized silica fine powder preferably has a hydrophobicity of from 30 to 80% when measured by a methanol titration method.

The silica fine powder is chemically or physically hydrophobized with an organic silicon compound.

Specific examples thereof include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chlorethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethyletoxysilane, trimethyletoxysilane, trimethylmetoxysilane, methyltrietoxysilane, isobutyltrimetoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxane having 2 to 12 siloxane units and 0 to 1 hydroxyl group bonded with Si at the end unit, etc. Further, silicone oils such as a dimethyl silicone oil can also be used. This can be used alone or in combination.

The fluidity improver preferably has a number-average particle diameter of from 5 to 100 nm, and more preferably from 5 to 50 nm.

The fluidity improver preferably has a specific surface area not less than 30 $m^2/g$, and more preferably from 60 to 400 $m^2/g$ when measured by a BET nitrogen absorption method. When a surface-treated fine powder, the fluidity improver preferably has a specific surface area not less than 20 $m^2/g$, and more preferably from 40 to 300 $m^2/g$.

The fluidity improver is preferably included in a toner in an amount of from 0.03 to 8 parts by weight per 100 parts by weight of the toner.

As other additives, various metal soaps, fluorine-containing surfactants and dioctylphthalate may optionally be included in the toner of the present invention for the purpose of protecting a photoreceptor or a carrier; improving the cleanability thereof; controlling heat, electrical and physical properties thereof; controlling the resistivity thereof; controlling the softening point thereof; and improving the fixability thereof; etc. As an electroconductivity imparting agent, inorganic fine powders such as tin oxide, zinc oxide, carbon black, antimony oxide, titanium oxide, aluminum oxide and alumina may optionally be included therein.

The inorganic fine powders may optionally be hydrophobized. Lubricants such as polytetrafluoroethylene, zinc stearate and polyvinylidene-fluoride; abrasives such as cesium oxide, silicon carbonate and strontium titanate; caking inhibitors; and developability improvers such as white and black particulate materials having polarities reverse to that of a toner can also be used in a small amount.

The additives preferably treated with various agents such as silicone varnishes, various modified silicone varnishes, silicone oils, various modified silicone oils, silane coupling agents, silane coupling agents having functional groups and other organic silicon compounds for the purpose of controlling the charge amount of the resultant toner.

The dry developer can be prepared by the following method.

The inorganic particulate materials such as a hydrophobic silica fine powder may be added to a developer to increase the storage stability, developability and transferability thereof.

A typical powder mixer is used to mix external additives, and preferably includes a jacket and is capable of controlling inner temperature. The external additive may gradually be added in the mixer or on the way of mixing to change the history of stressing the external additive. As a matter of course, the number of rotations, rotation speed, mixing time and mixing temperature of the mixer may be changed. A large stress may be applied to the external additive at the beginning, and a comparatively small stress is applied thereto then, or vice versa.

Specific examples of the mixers include V-type Mixer, Rocking Mixer, Loedge Mixer, Nauter Mixer and Henschel Mixer.

In order to control the shape of a toner, after toner constituents such as a binder resin and a colorant are melted and kneaded upon application of heat, cooled and pulverized, the shape of the toner is mechanically controlled by Hybridizer or Machanofusion. Alternatively, the toner constituents are dissolved and dispersed in a solvent capable of dissolving the binder resin, and the solvent is removed from the dispersion by a spray drier to prepare a spherical toner. A spherical toner can also be prepared by being heated in an aqueous medium. The methods are not limited thereto.

Inorganic particulate materials can externally be added to the toner of the present invention to supplement the chargeability thereof.

The inorganic particulate material preferably has a primary particle diameter of from 2 to 5 μm, and more preferably from 5 to 500 μm.

The inorganic particulate material preferably has a specific surface area of from 20 to 500 $m^2/g$ when measured by a BET nitrogen absorption method.

The inorganic particulate material is preferably included in a toner in an amount of from 0.01 to 5% by weight, and more preferably from 0.01 to 2.0% by weight based on total weight of the toner.

Specific examples of the inorganic particulate material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Besides, polymer particulate materials, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins can also be used.

The external additives can be treated with a surface treatment agent to increase the hydrophobicity to prevent deterioration of fluidity and chargeability even in an environment of high humidity. Specific examples of the surface treatment agent include a silane coupling agent, a sililating agent, a silane coupling agent having an alkyl fluoride group, an organic titanate coupling agent, an aluminum coupling agent a silicone oil and a modified silicone oil.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particulate materials prepared by a soap-free emulsifying polymerization method such as a polymethylmethacrylate particulate material and a polystyrene particulate material.

The polymer particulate materials comparatively have a narrow particle diameter distribution and preferably have a volume-average particle diameter of from 0.01 to 1 μm.

Any known photoreceptors such as an organic photoreceptor, am amorphous silica photoreceptor, a selenium photoreceptor and a zinc oxide photoreceptor can be used in the present invention.

Having generally described this invention, a further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Colorant Dispersion

First, 15 parts of carbon black (Regal 1400 from Cabot Corp.) and 3 parts of a pigment dispersant (AJISPER PB821 from Ajinomoto-Fine-Techno Co., Inc.) were primarily dispersed in 82 parts pf ethyl acetate by a mixer having a stirring blade.

The primary dispersion was further dispersed by DYNO-MIL to completely remove aggregates therein to prepare a dispersion.

Then, the dispersion was passed through a filter (made of PTFE) having pores of 0.45 μm to be dispersed to a submicron area.

Preparation of Resin and Wax Dispersion 100 parts of a polyester resin, 30 parts of the carbon black dispersion and 5 parts of a paraffin wax were dispersed by the mixer having a stirring blade for 10 min in a mixed solvent including 700 parts of ethyl acetate and 300 parts of methyl alcohol.

The solvent dilution completely prevented the pigment from aggregating.

The dispersion was passed through a filter (made of PTFE) having pores of 0.45 μm without clogging.

The dispersion had an electrolysis conductivity of 2.0 H $10^{-4}$ S/m.

The dispersion was fed to a nozzle 1 of a toner preparation apparatus 10 in FIG. 1.

A discharge orifice having the shape of a perfect circle and a diameter of 10 μm is formed on a nickel plate having a thickness of 20 μm by a femtosecond laser to form the nozzle. The orifice has a straight structure having the same diameter of 10 μm throughout the nozzle. A ring electrode is located facing the nozzle 2 mm apart therefrom, and a voltage was applied to the electrode from a high-voltage DC electrical source.

Further, an irradiation head of a photoionizer 4 (from Hamamatsu Photonics K.K.) is located 20 to 40 cm below the discharge orifice of the nozzle to widely irradiate soft X-ray to a charged droplet.

The resultant particulate materials were suctioned an collected by a filter having fine pores of 1 μm.

The toner was prepared under the following conditions:

Specific gravity of the dispersion: $\rho$=1.1888 $g/cm^3$

Dry air amount: Sheath air 2.0 l/min, Inner air 3.0 l/min
Dry air (dew-point temperature): −20° C.
Inner temperature: 27 to 28° C.
Orifice vibration: 220 KHz
Facing electrodes voltage: DC 5 kV
Radiation irradiator: photoionizer (soft X-ray irradiator)

The dried and solidified particulate material was a completely monodispersed parent toner having weight-average and number-average particle diameters of 6.0 μm when particle diameter distribution of the collected particulate material was measured by a flow-type particle image analyzer (FPIA-2000).

Figure 2:
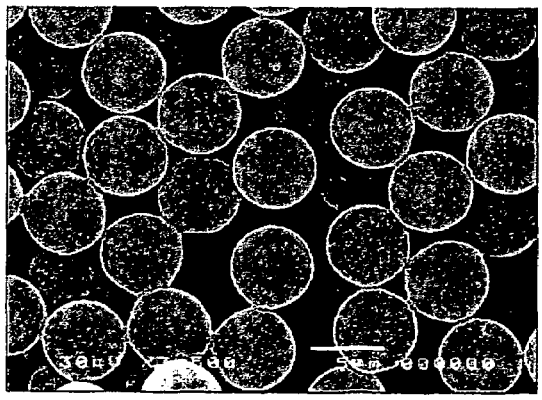
FIG. 2 is a scanning electron micrograph of a parent toner prepared in Example 1.

The scanning electron microgram of the parent toner is shown in FIG. 2.

Further, 0.2 parts of particulate silica treated with hexamethyldisilazane having a primary particle diameter of 7 nm were externally added to 100 parts of the parent toner by HENSCHEL MIXER to prepare a toner.

Example 2

The procedure for preparation of the toner in Example 1 was repeated to prepare a toner except for halving the orifice diameter to 5 μm and doubling the solid contents in the dispersion.

The parent toner was also completely monodispersed, having weight-average and number-average particle diameters of 6.0 μm.

Example 3

The procedure for preparation of the toner in Example 1 was repeated to prepare a toner except for doubling the orifice diameter and halving the solid contents in the dispersion.

The parent toner was also completely monodispersed, having weight-average and number-average particle diameters of 6.0 μm.

Example 4

The procedure for preparation of the toner in Example 1 was repeated to prepare a toner except for doubling the orifice vibration and the feeding amount of the dispersion.

The parent toner was also completely monodispersed, having weight-average and number-average particle diameters of 6.0 μm.

Example 5

The procedure for preparation of the toner in Example 1 was repeated to prepare a toner except for halving the orifice vibration and the feeding amount of the dispersion.

The parent toner was also completely monodispersed, having weight-average and number-average particle diameters of 6.0 μm.

Example 6

The procedure for preparation of the toner in Example 1 was repeated to prepare a toner except for using a styrene acrylic copolymer resin having a specific gravity of 1.05 instead of the polyester resin.

The parent toner was also completely monodispersed, having weight-average and number-average particle diameters of 6.0 μm, however, plural dimples are observed on the surface thereof.

Figure 3:
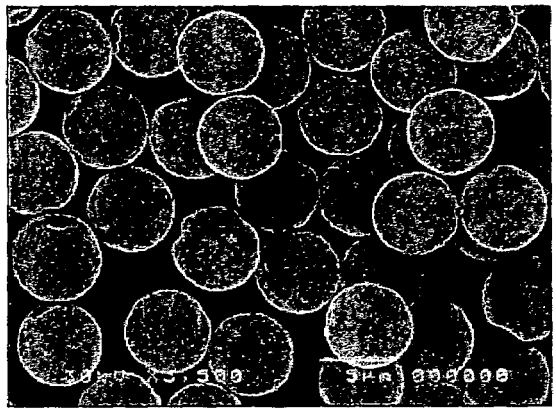
FIG. 3 is a scanning electron micrograph of a parent toner prepared in Example 6.

The scanning electron microgram of the parent toner is shown in FIG. 3.

Example 7

The procedure for preparation of the toner in Example 1 was repeated to prepare a toner except for concentrically forming 8 orifices, each having the shape of a perfect circle and a diameter of 10 μm within the scope of a circle having a diameter of 1.5 mm on a nickel plate having a thickness of 20 μm by a femtosecond laser.

The parent toner was also completely monodispersed, having weight-average and number-average particle diameters of 6.0 μm.

Example 8

Figure 4:
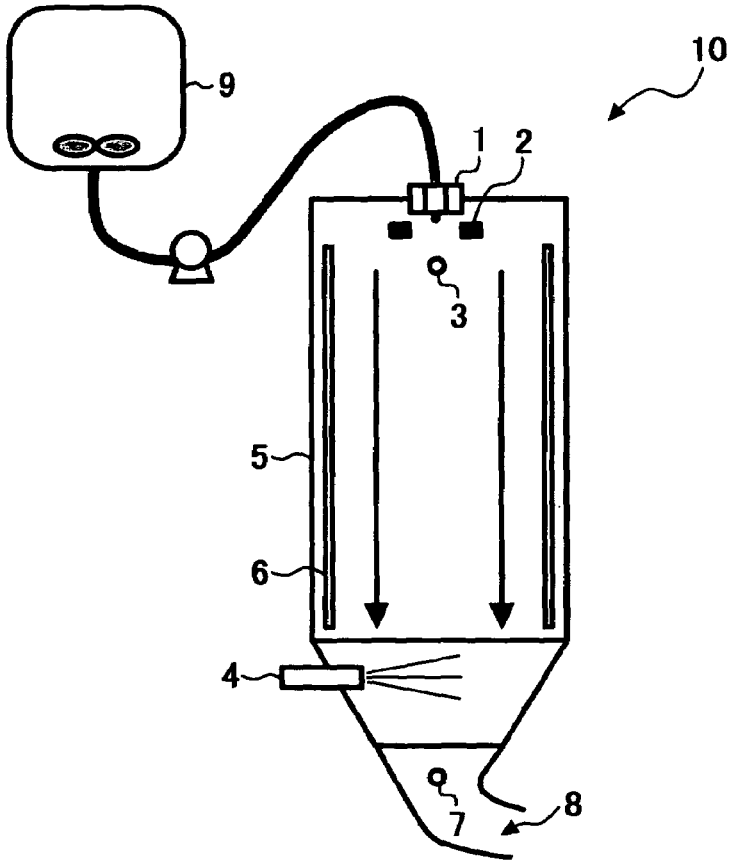
FIG. 4 a schematic view illustrating another embodiment of an apparatus with a nozzle for use in preparation of the toner of the present invention.

The procedure for preparation of the toner in Example 1 was repeated to prepare a toner except for transferring the irradiation head of a photoionizer 4 to the bottom of a dry container 5 a shown in FIG. 4 to irradiate soft X-ray to the charged droplets after completely dried just to discharge them instead of the droplets being dried.

Comparative Example 1

The following materials were melted and kneaded upon application of heat, cooled and hardened the melted and kneaded mixture, crushed and pulverized the hardened mixture, and classified the pulverized mixture to prepare a black parent toner having an average particle diameter of 6.8 μm.

| | |
|---|---|
| Styrene/acrylic copolymer resin | 100 |
| Carbon black | 10 |
| Carnauba wax | 5 |

The parent toner was expanded on one side of parallel plate electrodes having a size of 10 cm H 10 cm. The other side thereof was heated while helium gas was applied to the parent toner at a vacuum of $10^{-5}$ to $10^{-6}$ Torr for 3 min such that heat electron was generated to electretize the parent toner.

Further, 0.2 parts of particulate silica treated with hexamethyldisilazane having a primary particle diameter of 7 nm were externally added to 100 parts of the electretized parent toner by HENSCHEL MIXER to prepare a toner.

Comparative Example 2

The parent toner prepared in Comparative Example 1 was expanded on an aluminum plate having a size of 10 cm H 20 cm. The toner was corona-charged by a scorotron at a grid voltage of −800 V.

The parent toner was controlled to have a temperature of 60° C. while charged, and the temperature was decreased soon after charged to freeze the charge transfer from the parent toner so as to be electretized.

Further, 0.2 parts of particulate silica treated with hexamethyldisilazane having a primary particle diameter of 7 nm were externally added to 100 parts of the electretized parent toner by HENSCHEL MIXER to prepare a toner.

Next, each of the toners prepared in Examples 1 to 8 and Comparative Examples 1 and 2 was evaluated as follows.

[Charge Quantity]

The charge quantity of the toner was measured by a suction charge quantity measurer.

The toner was drawn to a Faraday gauge having a filter capable of collecting the toner, and an electrometer was connected thereto to measure total charge quantity of the toner drawn.

Then, the weight of the toner on the filter was measured, and the total charge quantity was divided thereby to determine a charge quantity per a unit weight.

[Charge Distribution]

The charge distribution of the toner was measured by a charge distribution measurer E-spart analyzer EST-2 from HOSOKAWA MICRON CORP.

The toner was directly introduced to an inlet of the measurer to measure the charge distribution thereof.

As an indicator of the charge distribution, a full width at half maximum peak is used.

[Electret Performance]

The electret toner has very high charge sustainability, and the charge quantity thereof does not change for several months when store at a room temperature and humidity, and the measurement takes much time.

Therefore, a heat-stimulated surface potential attenuation method was used to evaluate the electret performance.

This is a method of placing the electret toner on a hot plate being constantly heated, and measuring the toner temperature and surface potential thereof to evaluate the electret performance.

The heat-up speed was 4° C./min, 1 g of the toner was extended to have a thickness of 2 mm and a vibration surface potential measurer was used.

When the toner has higher electret performance, the surface potential is not attenuated even at higher temperature.

A starting temperature of the surface potential attenuation is an evaluation point.

In the present invention, soon after the toner is electretized, excessive ions are present on the surface thereof and they leave therefrom, resulting in the surface potential attenuation.

Therefore, the substantial electret performance was evaluated after leaving the toner for one day.

[Charge Quantity in an Environment of High-temperature and Humidity (HH)]

The toner was left at 30° C. and 90% RH for 12 hrs, and the charge quantity thereof was measured by the above-mentioned method.

[Thin Line Reproducibility]

100,000 images having an image area of 7% were produced with the toner on paper 6000 from Ricoh Company, Ltd. by imagio Neo 271, wherein the image developer was modified, from Ricoh Company, Ltd.

Thin line images of the 30,000th image and 100,000th image were observed and by an optical microscope at a magnification of 100 times, and compared with the original image to classify them to 4 grades (◎>○>Δ>x).

Particularly, the grade x is unmarketable. An organic photoreceptor was used for a negatively-charged toner, and an amorphous silicon photoreceptor was used for a positively-charged toner.

In developing method 1, the toner was directly transferred to a developing place in air stream as a powder cloud. In developing method 2, a resin-coated carrier used in conventional electrophotographies was used as a transferee.

The carrier was prepared by dispersing a silicone resin in toluene to prepare a dispersion, spray-coating the dispersion on a spherical ferrite core material having an average particle diameter of 50 μm upon application of heat. The coated core material was calcined and cooled to prepare a carrier having an average thickness of the coated resin of 0.2 μm.

The evaluation results of each toner prepared in Examples 1 to 8 and Comparative Examples 1 and 2 are shown in Table 1.

TABLE 1

| | Charge qty. (μC/g) | Charge qty. (HH) (μC/g) | Electret performance (° C.) | Charge distribution (fC/μm) | Thin line reproducibility (developing method 1) | Thin line reproducibility (developing method 2) |
|---|---|---|---|---|---|---|
| Example 1 | −35.0 | −34.8 | 92.3 | −0.44 | ◎ | ◎ |
| Example 2 | −35.5 | −35.1 | 93.4 | −0.44 | ◎ | ◎ |
| Example 3 | −34.5 | −33.6 | 92.7 | −0.43 | ◎ | ◎ |
| Example 4 | −34.5 | −34.8 | 92.9 | −0.45 | ◎ | ◎ |
| Example 5 | −35.2 | −34.4 | 93.4 | −0.44 | ◎ | ◎ |
| Example 6 | −35.4 | −33.7 | 93.1 | −0.43 | ◎ | ◎ |
| Example 7 | −35.7 | −34.7 | 94.5 | −0.47 | ◎ | ◎ |
| Example 8 | −16.2 | −15.5 | 92.4 | −0.23 | ◎ | ◎ |
| Comparative Example 1 | −3.5 | 0.35 | 50 | −0.05 | Undevelopable | X |
| Comparative Example 2 | −15.7 | 0.28 | 63 | −0.18 | Δ | Δ |

Table 1 shows that the toners of the present invention, prepared in Examples 1 to 8, were effectively electretized and have good electret performances.

In addition, the electretized toners faithfully developed electrostatic latent images to become quite good quality images.

On the contrary, the toners conventionally prepared in Comparative Examples 1 and 2 were charged much less than the toners of the present invention, and could not practically form sufficient quality images.

This application claims priority and contains subject matter related to Japanese Patent Application No. 2005-125277 filed on Apr. 22, 2005, the entire contents of which are hereby incorporated by reference.

Having now fully described the invention, it will be apparent to one of ordinary skill in the art that many changes and modifications can be made thereto without departing from the spirit and scope of the invention as set forth therein.

The invention claimed is:

1. A method of preparing a permanently-charged electret toner, comprising:

discharging a solution or dispersion comprising a resin and a colorant through a nozzle vibrating at a constant frequency to form a droplet;

applying a direct potential to an electrode facing the nozzle to positively or negatively charge the droplet by an induction phenomenon to form a charged droplet; and drying and solidifying the charged droplet to create permanently charged electret toner.

2. The method of claim 1, further comprising:

irradiating the charged droplet while drying and solidifying the charged droplet to be eternally charged.

3. The method of claim 1, wherein the nozzle vibrates at a constant frequency by expansion and contraction of a piezoelectric substance.

4. The method of claim 1, wherein the nozzle comprises:

a metal plate having a thickness of from 5 to 50 μm; and an orifice having a diameter of from 3 to 35 μm on the metal plate.

5. The method of claim 1, wherein the electrode comprises a pair of electrodes.

6. The method of claim 1, wherein the solution or dispersion has an electrolysis conductivity not less than 1.0 H $10^{-5}$ S/m.

7. The method of claim 1, wherein the solution or dispersion comprises a solvent having an electrolysis conductivity not less than 1.0 H $10^{-5}$ S/m.

8. The method of claim 1, further comprising:

transferring the droplet through a solvent remover on a dry gas to remove a solvent therefrom.

9. The method of claim 8, wherein the dry gas comprises air or a nitrogen gas.

10. The method of claim 8, wherein the solvent remover inner-circumferentially comprises an electrostatic curtain charged to have the same polarity as that of the droplet.

11. A method of preparing a permanently charged electret toner, comprising:

discharging a solution or dispersion comprising a resin and a colorant through a nozzle vibrating at a constant frequency to form a droplet;

applying a direct potential to an electrode facing the nozzle to positively or negatively charge the droplet by induction to form a charged droplet; and a step for creating permanently charged electret toner while drying and solidifying the charged droplet.

12. A method of preparing a permanently charged electret toner, comprising:

discharging a solution or dispersion comprising a resin and a colorant through a nozzle vibrating at a constant frequency to form a droplet;

applying a direct potential to an electrode facing the nozzle to positively or negatively charge the droplet by induction to form a charged droplet; and irradiating the charged droplet while drying and solidifying the charged droplet to create permanently charged electret toner.

* * * * *